US006422491B1

(12) United States Patent
Bilz et al.

(10) Patent No.: US 6,422,491 B1
(45) Date of Patent: Jul. 23, 2002

(54) METHOD AND DEVICE FOR ISOLATING AN ELECTRO-CONDUCTIVE FLOWING MEDIUM

(75) Inventors: Burkhard Bilz, Hoesbach; Udo Klein, Dietzenbach; Winfried Ott, Rodgau; Rainer Prauser, Erlenbach; Thomas Scholz, Mainhausen; Frank Wirth, Aschaffenburg, all of (DE)

(73) Assignee: LacTec GmbH Gesellschaft fuer moderne Lackiertechnik, Rodgau (DE)

( * ) Notice: Subject to any disclaimer, the term of this patent is extended or adjusted under 35 U.S.C. 154(b) by 0 days.

(21) Appl. No.: 09/581,730

(22) PCT Filed: Dec. 15, 1998

(86) PCT No.: PCT/DE98/03693

§ 371 (c)(1),
(2), (4) Date: Jun. 16, 2000

(87) PCT Pub. No.: WO99/32231

PCT Pub. Date: Jul. 1, 1999

(30) Foreign Application Priority Data

Dec. 18, 1997 (DE) ..... 197 56 488

(51) Int. Cl.[7] ..... B05B 5/025
(52) U.S. Cl. ..... 239/691
(58) Field of Search ..... 239/690, 691

(56) References Cited

U.S. PATENT DOCUMENTS

| | | | |
|---|---|---|---|
| 4,275,834 | A | 6/1981 | Spanjersberg et al. |
| 4,313,475 | A | 2/1982 | Wiggins |
| 4,921,169 | A | 5/1990 | Tilly |
| 5,083,711 | A | 1/1992 | Giroux et al. |
| 5,094,389 | A | 3/1992 | Giroux et al. |
| 5,197,676 | A | 3/1993 | Koniecynski et al. |
| 5,310,120 | A | 5/1994 | Ehinger et al. |
| 5,364,035 | A | 11/1994 | Ma et al. |
| 5,632,816 | A | 5/1997 | Allen et al. |

FOREIGN PATENT DOCUMENTS

| | | |
|---|---|---|
| DE | 4427704 | 6/1995 |
| EP | 0428435 | 5/1991 |
| EP | 0434535 | 6/1991 |
| EP | 0455106 | 11/1991 |
| EP | 0455109 | 11/1991 |
| EP | 0455111 | 11/1991 |
| EP | 0535896 | 4/1993 |
| EP | 0587467 | 3/1994 |
| EP | 0808665 | 11/1997 |
| WO | WO87/05832 | 10/1987 |

*Primary Examiner*—Lesley D. Morris
(74) *Attorney, Agent, or Firm*—W. F. Fasse; W. G. Fasse

(57) ABSTRACT

A voltage isolating device selectively electrically isolates from each other two points (13 and 15) of an electrically conductive flow medium having different electrical potentials along a flow path. The electrically conductive flow medium is conveyed in the inner space (18') of a freely protruding carrier (17') having at least one discharge opening (29). The carrier (17') moves back and forth between a first isolating position and a second docking position to allow a transfer flow. The discharge opening (29) is closed until the docking position has been reached, wherein the discharge opening is opened, and is closed again when the carrier is moved out of the docking position.

9 Claims, 3 Drawing Sheets

METHOD AND DEVICE FOR ISOLATING AN ELECTRO-CONDUCTIVE FLOWING MEDIUM

TITLE OF THE INVENTION

FIELD OF THE INVENTION

The invention relates to a method and a device for isolating points of an electrically conductive flow medium having a different electrical potential along its flow path, for example in an electrostatic painting system.

BACKGROUND INFORMATION

Methods and devices of the known art are technically complex, particularly if the flow medium is at ground potential at the beginning of its flow path and has high voltage applied to the flow medium at the end of its flow path. Such relationships dominate, for example, in electrostatic painting systems that process water-thinnable paints or lacquers, as are used, for example, in automobile manufacturing. In such electrostatic painting systems, paint or lacquer material is guided through a conduit or line to an atomizer or spray apparatus that is under a high voltage potential. If this paint or lacquer material is electrically conductable, it is important that an electrical short does not occur along the paint supply line, as the other end of the paint supply line is at ground potential. For this reason, a high voltage potential must also be applied to the paint supply line and the corresponding paint containers and the line, and the containers must be secured in a high voltage area to which access is prohibited. This, on the other hand, has as a consequence that the containers cannot be refilled from a supply line that is at ground potential during operation. As a result, the paint operation must be interrupted during the refilling procedure.

In order to ensure a continuous supply of the paint or lacquer material from a container under a high voltage potential to the atomizer or spray apparatus, the container must be filled discontinuously with paint or lacquer material in a suitable manner. This is in fact the actual practice with existing paint systems. As a further complication, generally several different colors or tones of the conductive paint or lacquer such as, for example, water-based lacquer, must be held ready for delivery to an atomizer or spray apparatus that is under high voltage via an automatic color changer. If voltage isolating devices are used between the color changer and the atomizer or spray apparatus, it is known that it is then impossible to quickly automatically flush all the components if the voltage isolating devices allow only short distances between the components under different potential during the painting operation, and if the devices are also to be constructed as compactly as possible.

In order to provide the necessary isolation in view of the governing potential between the components that are under high voltage and at ground potential, relatively large spaces or distances in the range of greater than 200 mm must be adhered to during the painting operation. Otherwise, the components cannot be switched between the inputs and outputs during the grounded operation, free of high voltage, to allow an automatic quick color change or a flushing cycle to be carried out.

SUMMARY OF THE INVENTION

It is, therefore, an object of the invention to provide measures that will allow a particularly practical handling and reliable isolation between points of the flow path and/or of the electrically conductive flow medium that are under different potential.

The above objects have been achieved according to the invention in a voltage blocking device for conveying an electrically conducting fluid therethrough, comprising: a housing including a housing outer wall and a first intermediate wall, wherein a first chamber and a second chamber are provided on opposite sides of the first intermediate wall within the housing outer wall, and wherein an annular receiving channel and an outlet opening are provided in the housing; an electrically insulating liquid contained in the second chamber; a movable nozzle needle having a free first end that is movably arranged in the housing and that has therein at least one radially extending discharge opening, and having a longitudinal channel that extends longitudinally axially in the movable nozzle needle and that communicates with the at least one radially extending discharge opening, wherein the free first end of the nozzle needle is movable between a first position and a second position within the housing, and wherein the free first end in the second position is located in the second chamber containing the electrically insulating liquid; a first drive connected to the movable nozzle needle and adapted to move the movable nozzle needle selectively between the first position and the second position; a first closure member that is movably arranged and guided in the first intermediate wall so as to selectively open and close the annular receiving channel; and a second closure member that is movably arranged so as to selectively open and close the at least one radially extending discharge opening in the free first end of the nozzle needle. In a particular embodiment of the invention, the annular receiving channel and the outlet opening are especially arranged in the intermediate wall. According to another embodiment feature of the invention, a further annular drainage channel is provided axially next to the annular receiving channel.

With the inventive arrangement, this means that the electrically conductive flow medium flows inside of a lance or nozzle needle that has a discharge opening and that moves between an isolating position and a docking position which allows the transfer flow of the flow medium, and back again. The discharge opening remains closed until the docking position has been reached. Thus, the electrically conductive fluid does not come into contact with the contacting walls so that the danger is low that a film of electrically conductive fluid will build up on the contacting surfaces and then lead to a short-circuit. Furthermore, the voltage-blocking valve that serves as the voltage-blocking device preferably has an electrically non-conductive fluid in the chamber that receives the lance or nozzle needle (also called the valve needle herein).

The voltage-blocking valve according to the invention further comprises end pieces for the flow path that can be connected to each other and released from each other, whereby these end pieces are arranged at the same time in the electrically non-conductive fluid. It is therefore possible to provide a voltage-blocking device that satisfies high safety requirements, yet is small in size, is simple to use, provides great switching speed, and is also practical in its handling.

BRIEF DESCRIPTION OF THE DRAWINGS

The invention will now be described in more detail, based on an example embodiment below that is represented in the drawing. Shown are.

DETAILED DESCRIPTION OF A PREFERRED EXAMPLE EMBODIMENT OF THE INVENTION

Figure 1:
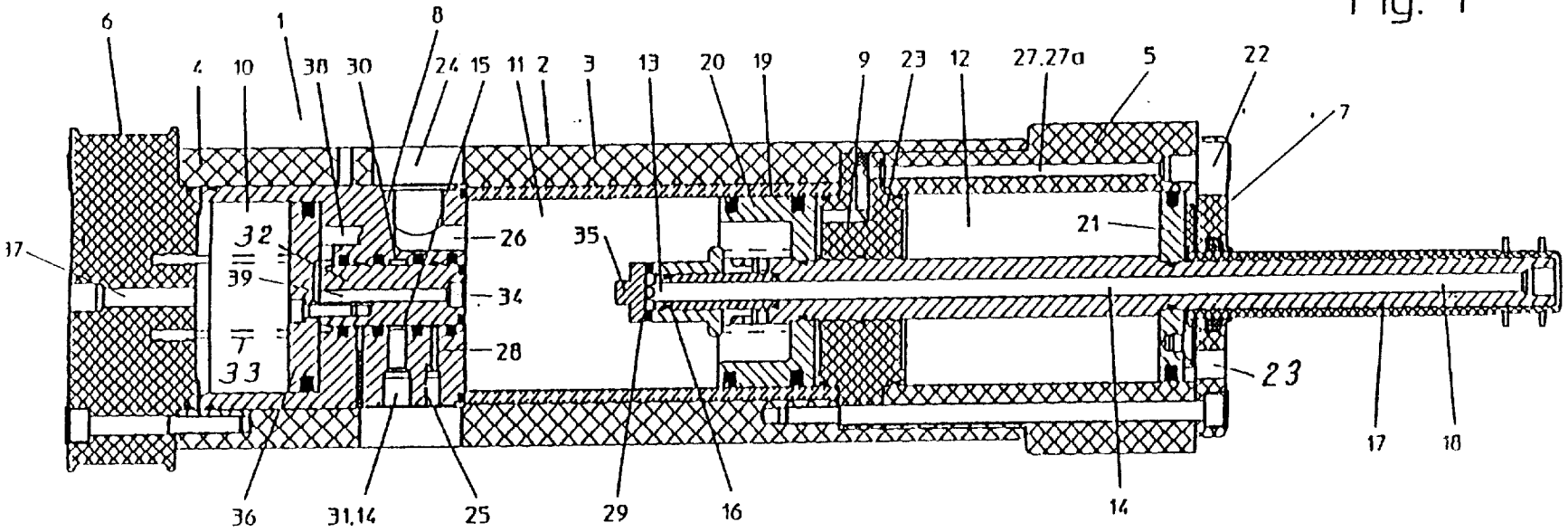
FIG. 1 a sectional view of a voltage-blocking device in its opened state.
Figure 2:
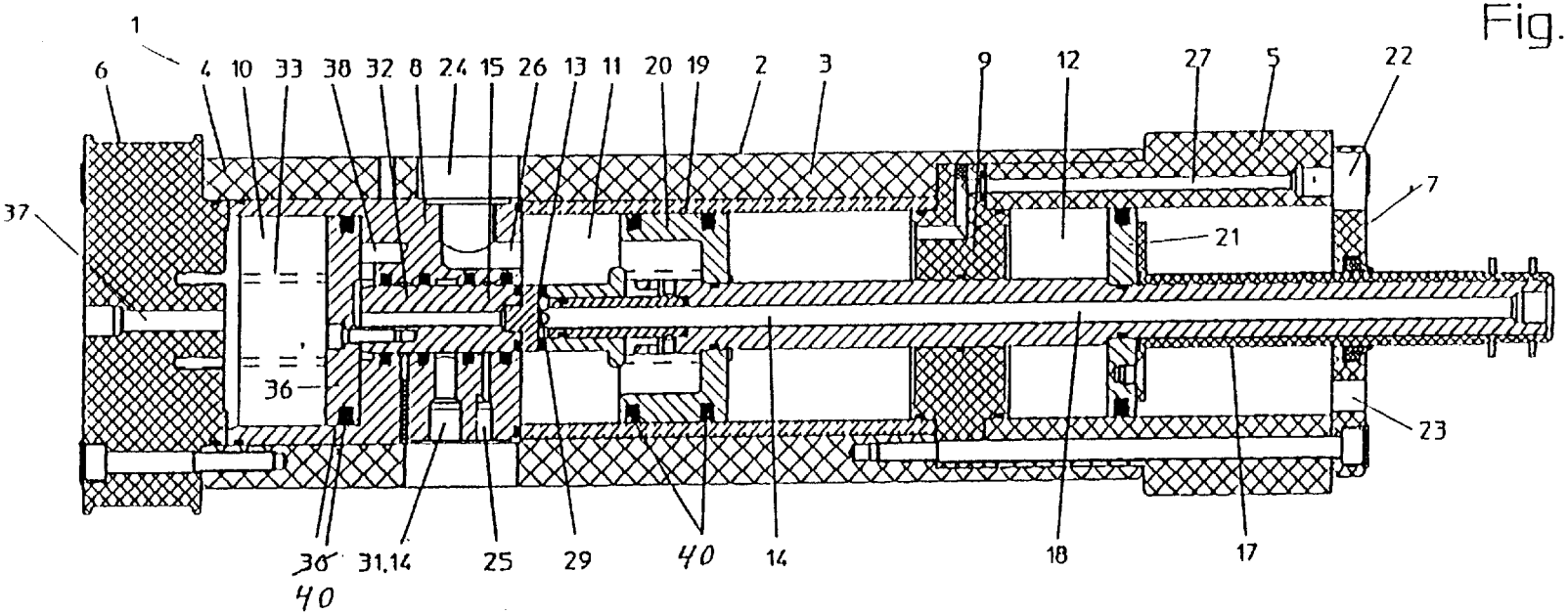
FIG. 2 a sectional view as shown in FIG. 1, shortly before closing the flow path.
Figure 3:
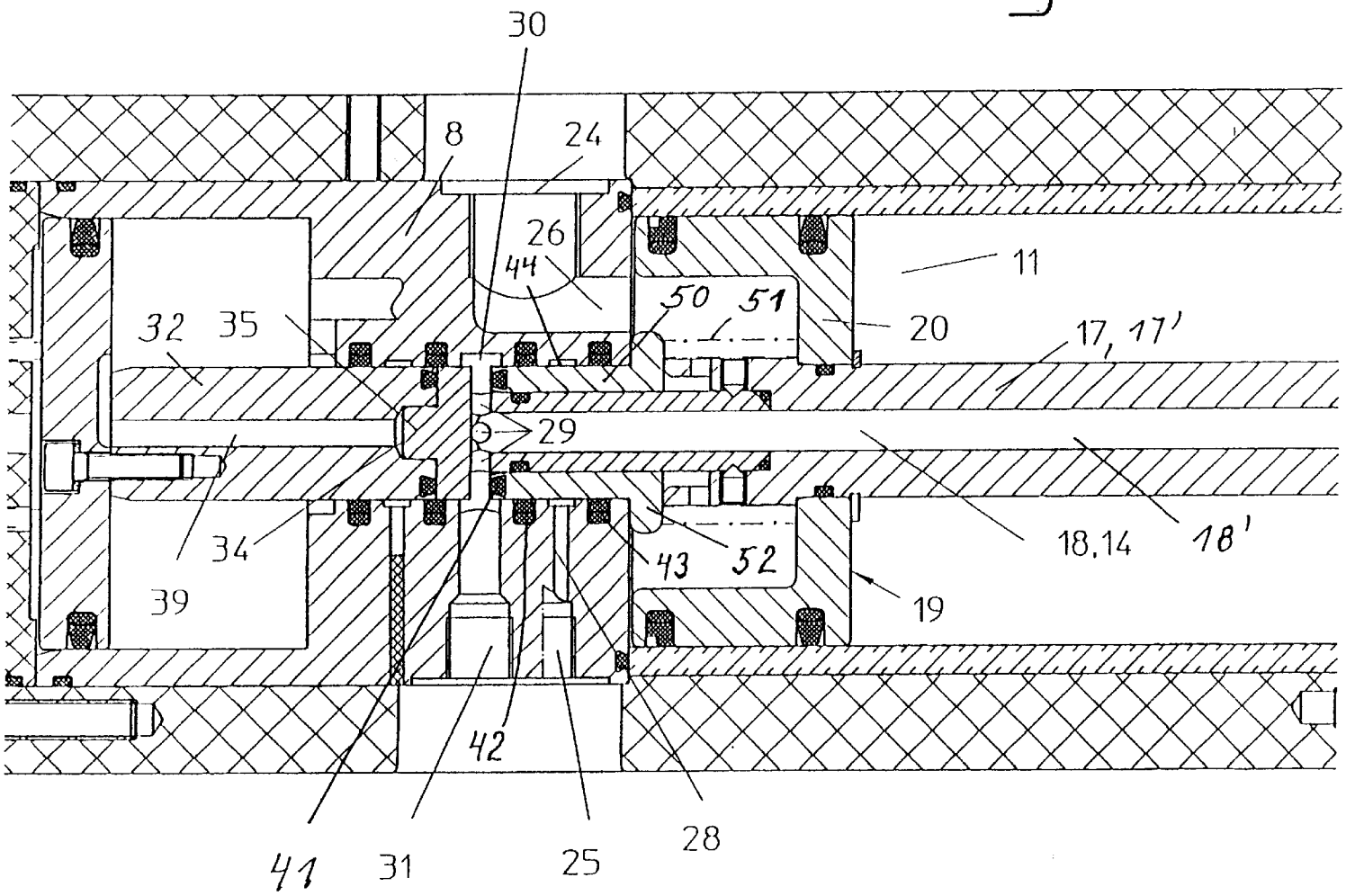
FIG. 3 a detail of the device shown in FIGS. 1 and 2, drawn to a larger scale, with a closed flow path.

A voltage-blocking device according to the example embodiment represented in the FIGS. 1 to 3 is a device that is switched as a voltage-blocking valve 1. The voltage-blocking valve 1 comprises a multi-piece housing 2 that consists primarily of an insulating material. The housing 2 comprises a centrally arranged cylindrical housing body 3 and covers 6, 7 arranged respectively at both ends 4, 5 that close the housing 2. Intermediate walls 8 and 9 are arranged in the housing 2 spaced apart from each other and from the covers 6 and 7. The intermediate walls 8 and 9 form on the one hand chambers 10, 11 and 12 in the internal space of the housing 2 and further serve for mounting and guiding components with the help of which a flow medium can flow from a first point 13 of a flow path 14 to a second point 15. The first point 13 and the second point 15 are at a different electrical potential, depending on the electrical switching state. The components thus serve to connect and interrupt the flow path 14 of the electrically conductive flow medium.

According to the example embodiment shown in the figures, the component that forms the first point 13 is the free end 16 of a nozzle needle 17, also called a valve needle 17 herein. The valve needle 17 has a longitudinal canal 18 and is connected, for example, to a line that has a low electrical potential. Accordingly, the flow medium that is then in the valve needle 17 has a low electrical potential.

Furthermore, a drive 19 is allocated to the valve needle 17 that acts on the valve needle 17 to move it relative to the second point 15, which comprises components that can be connected to and released from each other. This drive 19 comprises pistons 20 and 21 that can be pressurized via the connectors 22 and 23 so as to move the valve needle 17 in at least two directions, as can be seen in the figures. Compressed air that is supplied via the lines 27 or 27A serves as the pressure medium.

The free end 16 of the valve needle 17 (FIG. 1) is located in the middle chamber 11 that is always filled with isolating fluid and is closed at the endface according to the example embodiment. The flow path 14 or the longitudinal canal 18 terminates in the valve needle 17 at at least one discharge opening 29 that is radially oriented, which can be seen particularly in the representation in FIG. 3, drawn to a larger scale. An annular channel 30 is allocated to the one or more radially oriented discharge openings 29 and forms a receiving opening on the housing side and leads to a delivery port 31 that is oriented externally. The annular channel 30 is disposed in the intermediate wall 8 and is arranged such there that it is covered by a closure 32 when the voltage-blocking valve 1 is open, according to FIG. 1. This closure 32 is movable relative to the valve needle 17 and arranged along the axis of the valve needle 17. Pressure is applied to the closure 32 in the closing direction (FIGS. 1 and 2) by the force of pressure of a spring 33, for example. The closure 32 has a recess 34 on its endface facing the valve needle 17. A centering piece 35 at the free end 16 of the valve needle 17 projects into the recess 34 initially when the voltage-blocking valve 1 is closed, as shown in FIG. 2. When, however, the valve needle 17 is pushed still farther from the position shown in FIG. 2 in the axial direction toward cover 6, the closure 32 moves to the left into the position shown in FIG. 3 until it releases the annular channel 30. At the same time the discharge openings 29 of the longitudinal canal 18 of the valve needle 17 move from their position of FIG. 2 to the left until they are positioned in front of the annular channel 30 (FIG. 3).

As shown in FIG. 3, the discharge openings 29 are covered by a sleeve 50 that is axially slidable along the valve needle 17. A pressure spring 51 applies pressure to this sleeve 50. The sleeve 50 furthermore has a stop 52. Directly before the discharge openings 29 reach the annular channel 30, the stop 52 contacts a resistance so that the sleeve 50 can no longer move in the axial direction to the left despite further movement of the valve needle 17. This releases the discharge opening 29 (FIG. 3). Now, the flow medium, that is, the electrically conductive fluid, can flow through the valve needle 17 to the delivery port 31 arranged in the side of the housing. Thus, the valve needle 17 forms an end piece of the flow path 14. The second end piece of the flow path 14 is arranged on the housing side.

The valve needle 17 is a hollow valve needle or a freely protruding carrier 17' with an inner space 18' through which the electrically conductive flow medium flows. This carrier 17' itself moves between a first or isolating position and a docking position shown in FIG. 3. The electrically conductive fluid can flow when the carrier 17' is in the docking position. Basically, the carrier 17' retracts again as soon as the transfer flow operation has concluded. The discharge openings 29 on the free end of the carrier 17' are only open in the docking position and are otherwise closed by the sleeve 50 that serves as a closure on the side of the movable valve needle 17. In a comparable manner the annular channel 30 arranged on the housing side is always then closed with the aid of the closure 32 when the valve needle 17 is in the isolating position and is only then open when the valve needle 17 has reached the docking position. This means essentially that the electrically conductive fluid flows without contact with the limiting walls that move relative to each other when the voltage-blocking device opens and closes.

The flow path 14 is formed on the housing side by the annular channel 30 and the allocated delivery port 31. It shall be further understood that the direction of flow for the electrically conductive flow medium can also be oriented in the opposite direction.

As can be seen in the example embodiment represented in the figures, a piston 36 disposed in the chamber 10 is allocated to the closure 32 and is supplied with a pressure medium via a line 37.

Furthermore, an axially aligned relief bore 39 is disposed in the closure 32 so that the centering piece 35 can protrude into the recess 34, gap-free, when the valve needle 17 is docking.

Finally, seal elements 40 (FIG. 2) are required at all pistons and the closure 32, as well as between the covers 6 and 7 and the various assembled parts, and also to seal the valve needle 17. The seal elements 40 are shown in the figures. A seal element 41 arranged on an endface of the sleeve 50 is particularly significant. The seal element 41 contacts the endface of the centering piece 35 facing it after leaving the docking position according to FIG. 3.

Furthermore, according to the example embodiment, two seal elements 42 and 43, spaced a distance from each other, encircle the sleeve 50 in its docked state. The seal element 42 on the annular channel side serves simultaneously as a stripping or wiping element. An annular channel 44 disposed between the two sealing elements 42 and 43 in the intermediate wall 8 leads to the previously mentioned line 28 and the connector 25. If necessary, entrained electrically conductive fluid shall be collected here and drained off through the connector 25.

The sealing elements shown in the figures and allocated to the closure 32, the annular or ring channel and its outflow line possess basically similar function and significance.

All other sealing elements shown in the figures shall not be described in greater detail here. Basically, the same applies to the separation of the housing 2 into various housing components, so that the desired function is ensured. Thus, it is fundamentally possible even in certain cases to operate the voltage-blocking valve 1 according to the invention without an electrically non-conductive fluid because the construction of the voltage-blocking valve 1 provides a very high degree of achievable isolation. For this reason, the invention is not limited to the particular example embodiment shown in the figures. Rather, it is still possible to make modifications without deviating from the fundamental concept of the invention.

For application in a paint system the invention comprises essentially a voltage-blocking valve that can be arranged between a grounded paint supply line and a supply container or between the supply container and an atomizer or spray apparatus under high voltage. The paint intake port, which is at ground potential, is arranged via the fluid isolating medium such a short geometrical distance from the paint output port that is at high voltage. This distance is so short that it can be bridged in the shortest time when the supply line docks to the paint discharge port, at which time the switching state provides ground potential to both sides. Thus, it is possible that different voltage-blocking valves that are switched in series, including supply containers that are arranged between the valves, can be integrated into an automatic color change and flush or rinse cycle. A completely open and automatically flushable supply line can be switched between a grounded paint or lacquer supply hose and the atomizer or spray apparatus. The voltage-blocking valve that is constructed as a hollow needle valve comprises thereby a paint or lacquer supply lance that is slidably arranged, for example, in the chamber filled with the fluid isolating medium under exclusion of air, and at ground potential a short distance from a docking station that is alternatively at high voltage or at ground potential and that can be introduced into the docking station by a preferably pneumatically actuated thrust device. The docking station forms a valve that maintains a closed path to a subsequently switched supply container as long as the paint supply lance has not docked, and opens the path when the lance docks in such a way that the paint or lacquer material that is available in the hollow needle valve remains reliably separated from the surrounding isolating medium. This prevents an overflow of paint material into the isolating medium or from the isolating medium into the paint material. The docking station thereby encloses the introduced hollow needle valve airtight and fluid-tight, and the hollow needle valve opens only in the docked state when it is encircled by an outer sleeve of the docking station.

The piston carrying the paint supply lance/valve needle 17 furthermore cleans the inner wall of the chamber that receives the piston from deposits as it moves between the docking and the undocking or isolating positions. The piston thus serves, with its docking and undocking movement, simultaneously, as a recirculating pump for the isolating medium.

Basically, the longitudinal canal 18 in the valve needle 17 is a freely protruding carrier 17' about the inner space 18'. The carrier 17' is movable from an isolating position into a docking position, which then allows the transfer flow of the electrically conductive fluid to take place. The annular channel 30 thereby serves as a receiving opening in the housing side and is opened only in the docking position. The same applies for the discharge opening 29 at the freely protruding carrier 17' or the valve needle 17.

The various parts are manufactured from basically known materials, whereby insulating materials can also be used in part.

What is claimed is:

1. A voltage blocking device for conveying an electrically conducting fluid therethrough, comprising:

a housing (2) including a housing outer wall and a first intermediate wall (8), wherein a first chamber (10) and a second chamber (11) are provided on opposite sides of said first intermediate wall (8) within said housing outer wall, wherein an annular receiving channel (30) and an outlet opening (31) are provided in said housing, and wherein an annular drainage channel (44) is provided in said housing axially next to said annular receiving channel (30);

an electrically insulating liquid contained in said second chamber (11);

a movable nozzle needle (17) having a free first end that is movably arranged in said housing and that has therein at least one radially extending discharge opening (29), and having a longitudinal channel that extends longitudinally axially in said movable nozzle needle and that communicates with said at least one radially extending discharge opening (29), wherein said free first end of said nozzle needle is movable between a first position and a second position within said housing, and wherein said free first end in said second position is located in said second chamber containing said electrically insulating liquid;

a first drive (19, 20, 21) connected to said movable nozzle needle and adapted to move said movable nozzle needle selectively between said first position and said second position;

a first closure member (32) that is movably arranged and guided in said first intermediate wall so as to selectively open and close said annular receiving channel (30); and a second closure member (50) that is movably arranged so as to selectively open and close said at least one radially extending discharge opening (29) in said free first end of said nozzle needle.

2. The voltage blocking device according to claim 1, wherein, in said first position, said first closure member (32) is moved away from said annular receiving channel (30) so as to open said annular receiving channel, said second closure member (50) is moved away from said at least one radially extending discharge opening (29) so as to open said at least one radially extending discharge opening, and said free first end of said movable nozzle needle is located so that said at least one radially extending discharge opening communicates with said annular receiving channel which further communicates with said outlet opening (31), to establish a continuous flow path between said longitudinal channel of said movable nozzle needle and said outlet opening; and wherein, in said second position, said first closure member closes said annular receiving channel, said second closure member closes said at least one radially extending discharge opening, and said free first end of said movable nozzle needle is surrounded by said electrically insulating liquid in said second chamber.

3. A voltage blocking device for conveying an electrically conducting fluid therethrough, comprising:

a housing (2) including a housing outer wall and a first intermediate wall (8), wherein a first chamber (10) and a second chamber (11) are provided on opposite sides of said first intermediate wall (8) within said housing outer wall, and wherein an annular receiving channel (30) and an outlet opening (31) are provided in said first intermediate wall (8);

an electrically insulating liquid contained in said second chamber (11);

a movable nozzle needle (17) having a free first end that is movably arranged in said housing and that has therein at least one radially extending discharge opening (29), and having a longitudinal channel that extends longitudinally axially in said movable nozzle needle and that communicates with said at least one radially extending discharge opening (29), wherein said free first end of said nozzle needle is movable between a first position and a second position within said housing, and wherein said free first end in said second position is located in said second chamber containing said electrically insulating liquid;

a first drive (19, 20, 21) connected to said movable nozzle needle and adapted to move said movable nozzle needle selectively between said first position and said second position;

a first closure member (32) that is movably arranged and guided in said first intermediate wall so as to selectively open and close said annular receiving channel (30); and a second closure member (50) that is movably arranged so as to selectively open and close said at least one radially extending discharge opening (29) in said free first end of said nozzle needle.

4. The voltage blocking device according to claim 3, wherein, in said first position, said first closure member (32) is moved away from said annular receiving channel (30) so as to open said annular receiving channel, said second closure member (50) is moved away from said at least one radially extending discharge opening (29) so as to open said at least one radially extending discharge opening, and said free first end of said movable nozzle needle is located so that said at least one radially extending discharge opening communicates with said annular receiving channel which further communicates with said outlet opening (31), to establish a continuous flow path between said longitudinal channel of said movable nozzle needle and said outlet opening; and wherein, in said second position, said first closure member closes said annular receiving channel, said second closure member closes said at least one radially extending discharge opening, and said free first end of said movable nozzle needle is surrounded by said electrically insulating liquid in said second chamber.

5. The voltage blocking device according to claim 3, wherein said first closure member (32) is cylindrical.

6. The voltage blocking device according to claim 3, wherein said housing outer wall includes a housing end wall, said movable nozzle needle further has an outwardly protruding second end opposite said free first end, and said movable nozzle needle passes movably through said housing end wall with said outwardly protruding second end of said movable nozzle needle protruding outwardly outside of said housing.

7. The voltage blocking device according to claim 3, wherein said housing further includes a second intermediate wall (9), said second chamber (11) containing said electrically insulating liquid is bounded between said first and second intermediate walls (8, 9), a third chamber (12) is provided within said housing outer wall on a side of said second intermediate wall (9) opposite said second chamber (11), said first drive comprises a first piston (21) arranged in said third chamber (12) and connected to said movable nozzle needle (17), and said voltage blocking device further comprises a second piston (36) arranged in said first chamber (10) and connected to said first closure member (32).

8. The voltage blocking device according to claim 3, further having an annular drainage channel (44) provided in said first intermediate wall axially next to said annular receiving channel (30).

9. The voltage blocking device according to claim 3, further comprising said electrically insulating liquid further contained in said first chamber (10).

* * * * *